US005148874A

United States Patent [19]

Foppe

[11] Patent Number: 5,148,874

[45] Date of Patent: Sep. 22, 1992

[54] HIGH-PRESSURE PIPE STRING FOR CONTINUOUS FUSION DRILLING OF DEEP WELLS, PROCESS AND DEVICE FOR ASSEMBLING, PROPELLING AND DISMANTLING IT

[75] Inventor: Werner Foppe, Geilenkirchen, Fed. Rep. of Germany

[73] Assignee: Technologie Transfer Establishment, Liechtenstein

[21] Appl. No.: 656,134

[22] PCT Filed: May 3, 1990

[86] PCT No.: PCT/CH90/00123

§ 371 Date: Mar. 1, 1991

§ 102(e) Date: Mar. 1, 1991

[87] PCT Pub. No.: WO90/13729

PCT Pub. Date: Nov. 15, 1990

[30] Foreign Application Priority Data

May 3, 1989 [DE] Fed. Rep. of Germany ..... 3914617

[51] Int. Cl.[5] ..... E21B 7/14

[52] U.S. Cl. ..... 175/11; 175/19; 166/77.5

[58] Field of Search ..... 175/11, 12, 14, 13, 175/19

[56] References Cited

U.S. PATENT DOCUMENTS

| | | | |
|---|---|---|---|
| 3,193,918 | 7/1965 | Heldenbrand . | |
| 3,467,206 | 7/1967 | Acheson et al. | 175/13 |
| 3,476,194 | 11/1969 | Browning | 175/13 |
| 3,690,136 | 9/1972 | Slator et al. | 166/77 X |
| 3,791,697 | 5/1972 | Hokao et al. | 175/13 |
| 3,817,466 | 6/1974 | Reynard et al. . | |
| 3,841,407 | 10/1974 | Bozeman | 166/79 X |
| 4,099,584 | 7/1978 | Frankle et al. | 175/14 |
| 4,193,461 | 3/1980 | Lamberton et al. | 175/19 |
| 4,523,644 | 6/1985 | Dismukes . | |
| 4,585,066 | 4/1986 | Moore et al. . | |
| 5,040,926 | 8/1991 | Andreasson | 175/19 X |

FOREIGN PATENT DOCUMENTS

| | | |
|---|---|---|
| 2554101 | 6/1977 | Fed. Rep. of Germany . |
| 2756045 | 6/1985 | Fed. Rep. of Germany . |
| 3701676 | 1/1987 | Fed. Rep. of Germany . |
| 2483509 | 12/1981 | France . |
| 733628 | 7/1955 | United Kingdom . |

*Primary Examiner*—Thuy M. Bui
*Assistant Examiner*—Frank S. Tsay
*Attorney, Agent, or Firm*—Speckman & Pauley

[57] ABSTRACT

A high pressure pipe string for continuous fusion drilling of deep wells which houses supply lines, measurement instrumentation and control wiring of the drilling device. It has at least two shell elements forming two halves of a pipe, and these parts are assembled into a smooth, tight, and compression and tension resistant pipe. In a process for assembling, propelling and subsequently dismantling a high-pressure pipe string for continuous fusion drilling of deep wells, the supply lines, the measurement instrumentation and the control wiring are fed to the boring head in a continuous manner. The supply lines, the measurement instrumentation and the control wiring are encased in a tight, compression and tension resistant high-pressure pipe string having several parts, the assembled pipe string being continuously propelled downward into the boring. The device for the execution of one of these processes has one storage carrousel for each of the supply lines, on which the supply lines are wound. Such a storage carrousel has a circular, rotating and motor-driven platform designed to hold the wound up supply lines. It also has a multilevel assembly tower housing the elements for assembling the pipe segments, to propel the pipe string downward into the boring, and to subsequently retrieve and dismantle the pipe string.

22 Claims, 4 Drawing Sheets

HIGH-PRESSURE PIPE STRING FOR CONTINUOUS FUSION DRILLING OF DEEP WELLS, PROCESS AND DEVICE FOR ASSEMBLING, PROPELLING AND DISMANTLING IT

BACKGROUND OF THE INVENTION

1. Field of the Invention

This invention relates to a high-pressure pipe string for the continuous fusion drilling of deep wells. It relates further to a process for the assembly of this high-pressure pipe string, for propelling it in the boring and for dismantling it. This invention also relates to an apparatus for the execution of the afore-mentionned processes.

Continuous fusion drilling is a drilling method in which extremely high temperatures are generated at or slightly ahead of the boring head, leading to the melting of the rock. The rock melt is evacuated into the surrounding, thermofractured (fractured by local thermal stresses) rock formation by high, locally applied pressure. The boring head can, as a result, be continuously propelled forward, melting the rock ahead of it and pushing the melt out into the surrounding cracks.

2. Description of Prior Art

Two continuous fusion drilling techniques are described in the German patent specification DE25 54 101 C2 and in the German patent disclosure 37 01 676 A1. The temperatures required to melt the rock are generated by high-pressure, hydrogen/oxygen flame jets. The process according to the German patent specification DE25 54 101 C2 is designed to effectuate a total evacuation, by high applied pressure, of the rock melt into the surrounding rock. The process according to the German patent disclosure 37 01 676 A1, on the other hand, is a profiling fusion drilling process in which only a minimal, outer profile of the boring is melted and removed, to provide a passage for the drilling device and the supply lines. The resulting melt from this area is pushed into the drilling core. After a partial cooling, the core segments are sheared off and removed to the surface. Both fusion drilling processes are designed to operate in a continuous fashion, i.e. the deep well is completed in a single, continuous thrust. The cooled melt forms a casing for the bore hole, thus providing a guide channel for the fusion drilling device and preventing cave-ins of the boring walls. The bore head can be designed for a specified service life, so that deep wells up 10,000–15,000 meters can be realized in a single, continuous process, without any time and energy-consuming "round trips."

Reliable processes must be chosen to prevent technical problems leading to interruptions of the fusion drilling process. This means processes that incorporate a minimal number of possible sources of problems, and with a sufficient redundancy in the operational systems so that a replacement unit can immediately take up the functions of any defective part of the system. A continuous drilling process significantly raises the boring velocity and can thus drastically reduce the costs of realizing a deep well. These advantages are intrinsic qualities of the fusion drilling process, which eliminates the need for the "round trips" to change the bore head and the boring rods or pipes or to remove the core, which characterizes conventional, mechanical boring methods. These advantages can, however, only be exploited if the power supply to and control of the bore head can also be performed in a continuous manner. A continuous supply of hydrogen, oxygen and cooling water at a pressure of about 2,000 bars and a vertical, mechanical driving force to the bore head are required for the realization of continuously fusion-drilled deep wells. The risk of leaks or ruptures in the joints and the possibility of signal interruptions in control wiring connectors practically exclude a segmental assembly of the high-pressure hydrogen, oxygen and cooling water supply lines. Other means must therefore be provided to carry out the continuous power supply and uninterrupted control of the bore head. These means must allow the forward motion and retrieval of the pipe string with all its supply lines and its control equipment.

SUMMARY OF THE INVENTION

An object for this invention is to provide a high-pressure pipe string for the continuous fusion drilling of deep wells. A further object for this invention is to provide a process for the assembly of this high-pressure pipe string, for propelling it in the boring and for dismantling it after completion of the well.

The proposed object is achieved, according to one preferred embodiment of this invention, by a high-pressure pipe string which houses the supply lines, the measurement instrumentation and the control wiring for the drilling device. Its construction, has at least two shell elements forming the two halves of the pipe segments and can be assembled into a continuous, smooth, tight, and compression and tension resistant, pipe.

The proposed object is also achieved by a process for the assembly, the propelling and the subsequent dismantling of a high-pressure pipe string for the continuous fusion drilling of deep wells. In the process, whose speed is synchronized to the boring velocity, the continuous supply lines, the measurement instrumentation and the control wiring are encased in a modular, segmentally assembled, high-pressure pipe string and continuously fed to the drilling device.

The proposed object is further achieved by a device for the execution of the above-mentioned process. The device has a storage carrousel and an assembly tower. The storage carrousel receiving the wound up supply lines, the measurement instrumentation and the control wiring consists of a circular, rotating, motor-driven platform. The multi-level assembly tower houses the means to assemble the pipe segments, to propel the pipe string downward into the boring and to dismantle the pipe string after completion of the deep well.

BRIEF DESCRIPTION OF THE DRAWINGS

The description of the invention is supported by the following illustration wherein.

DESCRIPTION OF PREFERRED EMBODIMENTS

The principal features of the high-pressure pipe string according to the invention as well as especially advantageous processes and devices for the execution of the processes are described in the patent claims and explained more in detail in the following description.

The hydrogen, oxygen and cooling water supply lines to the boring head as well as the control and measurement wiring according to the invention are continuous. This means the supply and control lines must be produced in one continuous, up to 15 km long, piece for the total length of the boring. These pipes must therefore be produced on site, since the total dimensions of the system make transportation prohibitive. The hydrogen and oxygen supply lines are made of an appropriate steel alloy. These supply lines must be able to withstand a pressure of about 2000 bars and must have an outside diameter of about 20 mm. The cooling water lines are somewhat larger, with an outside diameter of about 50 mm. The wall thickness of the supply lines should be about $\frac{1}{4}$ to $\frac{1}{3}$ of the outside diameter in order to withstand the high pressures. Such profiles can relatively easily be wound into loops with a radius of about 20 m without undergoing any plastic deformation. Even pipes with larger radii would remain elastic at this large winding radius.

The invention concerns a high-pressure pipe string which would feed these supply lines into the boring in a continuous manner. The high-pressure pipe string is designed to contain and protect the system of supply lines. It furthermore should take up the tensile and compressive forces necessary to propel the bore head forward and to retrieve it after the deep well is completed.

Figure 1:
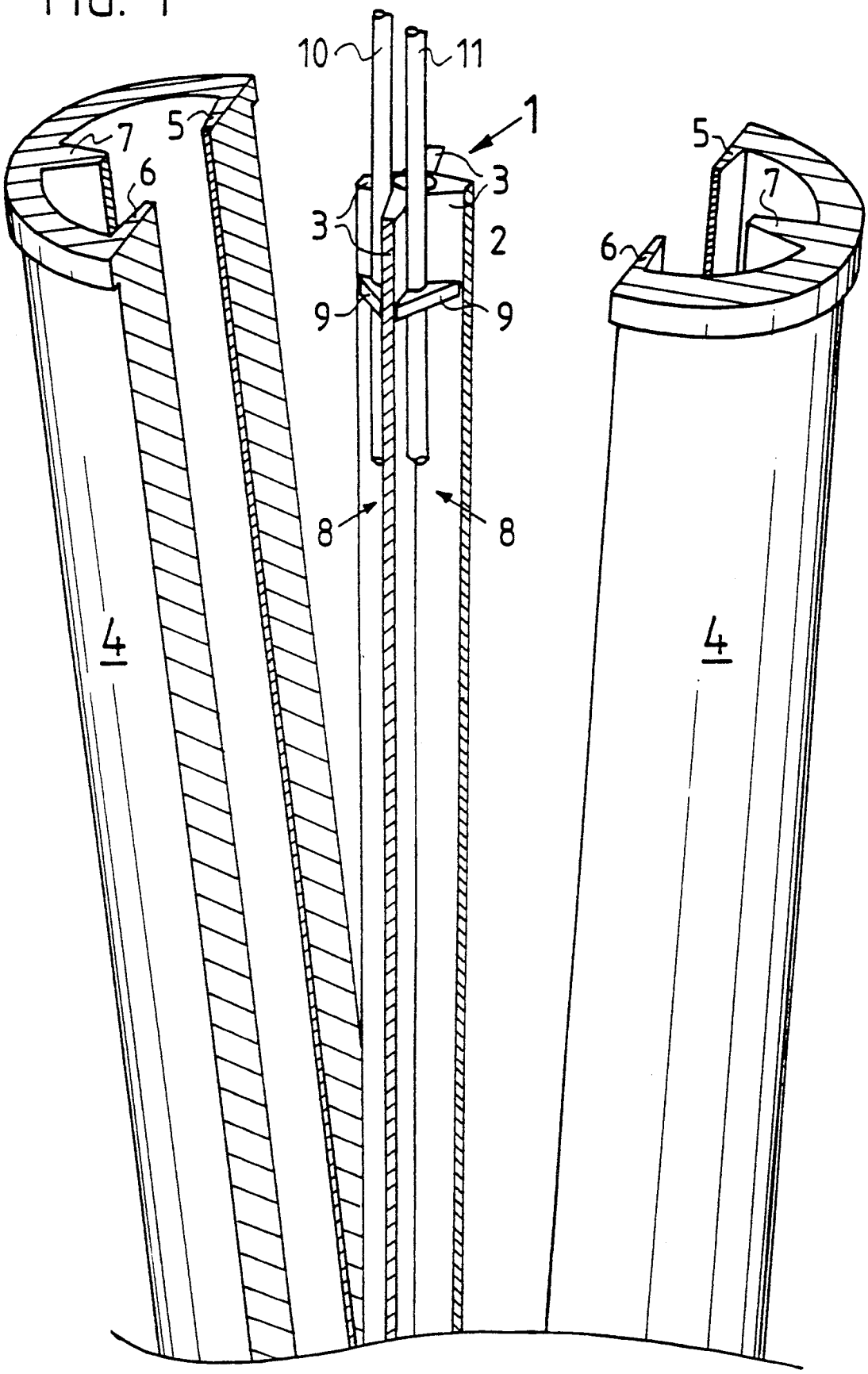
FIG. 1 exploded view of the three main components of a high-pressure pipe string segment.

FIG. 1 shows a pipe string segment before assembly. It comprises of three parts: an inner profile 1 with a central pipe 2 having four profiles 3 arranged in a cross shape on its outer side, and two similar shell elements 4, forming the two halves of a pipe segment. These shell elements have radial ribs 5, 6, 7 on their inner side. The geometry of the three parts 1, 4 is such that the ribs 5, 6, 7 on the inner side of the shell elements fit on the outer edge of the inner profiles 3. The hatched areas on the parts 1, 4, as shown in FIG. 1, are designed to be fitted together and bonded. The inner profile 1 is mounted on the fusion drilling device or on the tail section of the high-pressure pipe string before assembly of the two outer segments 4. The continuous supply lines 10, 11 are fastened within the open areas 8 of the inner profile 1 by means of isolating mounts 9. The mounts 9 hold the lines 10, 11 in place by frictional forces. The outer shell segments 4 are then assembled around the inner profile 1 carrying the supply lines 10, 11. The assembly is accomplished with a heat resistant, hot-curing, industrial-grade adhesive with a high shear and tensile strength. The pipe string is extended by the assembly of successive sets of these three parts.

Figure 2:
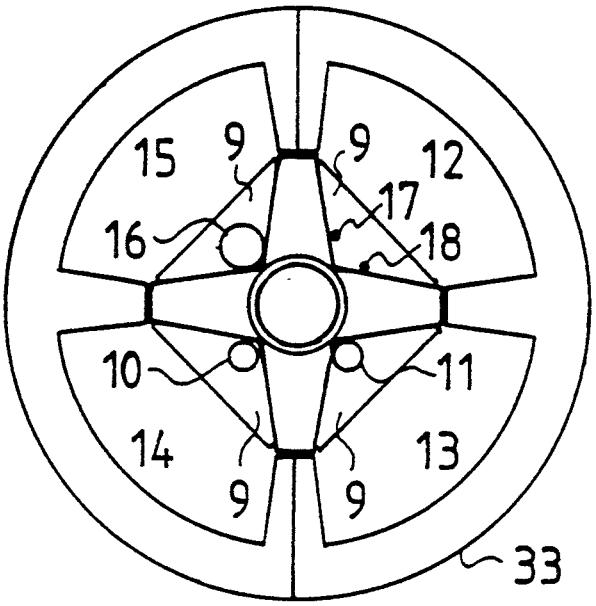
FIG. 2 top view of the assembled high-pressure pipe string.

FIG. 2 shows a top view of an assembled pipe segment. The cross section, with a hollow profile having four open areas 12–15, combines a high stability and low weight. All continuous supply lines for hydrogen 10, oxygen 11 and cooling water 16 as well as the wiring for the measurement 17 and control 18 systems of the bore head are fastened to the inner profile with isolating mounts 9.

Figure 3:
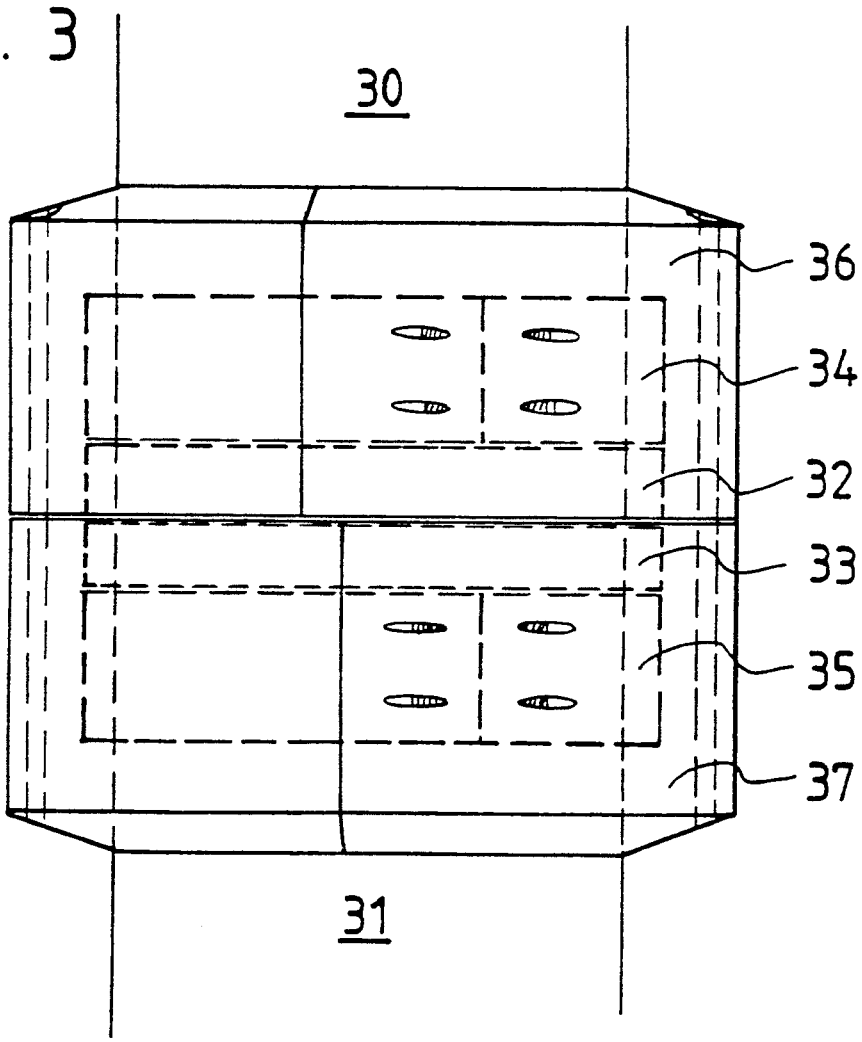
FIG. 3 typical connection between two pipe string segments.

FIG. 3 shows a connection between two successive pipe segments 30, 31. Each segment has a length of about 20 m. The outer shell elements have a lip 32, 33 at each end. A two-part stabilizer ring 34, 35 is mounted behind each of the flanges formed by these lips 32, 33. The two halves of these rings are adhesively bonded together and to the pipe. They can additionally be screwed together, for an increased bond strength. The stabilizer rings 34, 35 reinforce the pipe and provide an increased area for bonding at the ends of the pipe segments 30, 31. Two-part fastening sleeves 36, 37 are mounted over the stabilizing rings 34, 35 and bonded to them. These sleeves 36, 37 can be screwed together in the axial direction, thus pulling together the adjoining pipe segments 30, 31 and securing them during bonding. This connection allows a large number of pipe segments to be joined to form a long high-pressure pipe string. The connection is strong enough to take up the tensile loads imposed on the pipe string during its retrieval after the completion of a deep well. The pipe string can be pulled up by a hydraulic jack system whose catches or grippers would grasp the fastening sleeves 36, 37 of the connection. A further function of the connections is to act as distancers between the pipe string and the walls of the boring, to protect the pipe from frictional damage. The dismantling of the pipe string 48 after completion of the boring is carried out in reverse assembly order. The adhesively bonded surfaces are separated by heating them to a temperature above the heat resistance temperature of the adhesive. The individual components can thus be recovered.

Figure 4:
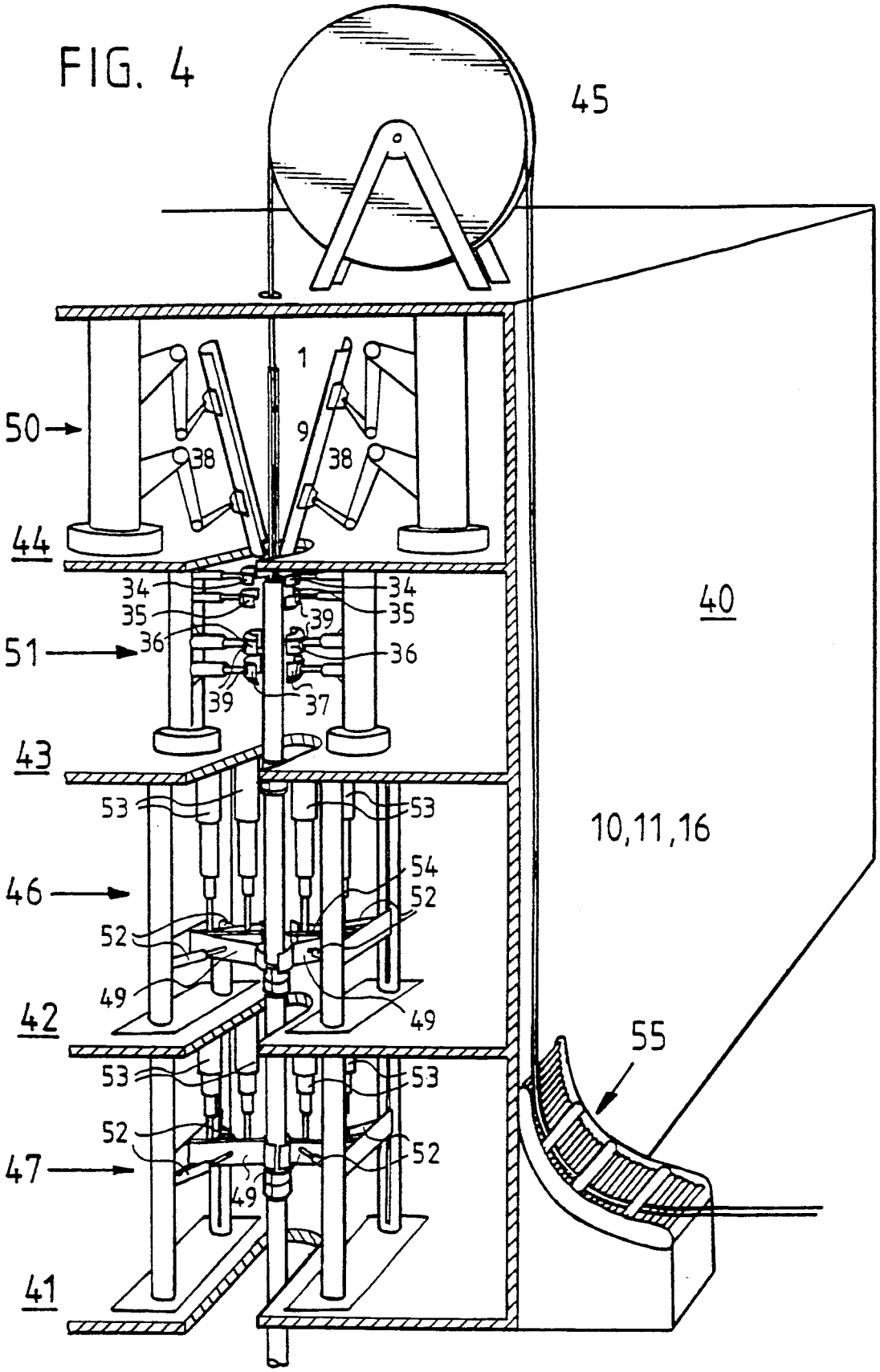
FIG. 4 shows a sectional view of an assembly tower for the assembly, propulsion, and dismantling of the high-pressure pipe string.

The components of the pipe are assembled into a tight, tension and compression resistant, high-pressure pipe string in a multi-level assembly tower located over the boring site. The tower also provides the means to lead the continuous supply lines and the measurement and control wiring into the boring and to apply pressure on the fusion drilling device. Such an assembly tower 40 is shown in FIG. 4. It is divided into four levels 41–44. The continuous supply lines 10, 11, 16 for hydrogen oxygen and cooling water are supplied by a carrousel, described below. They are led through a deflector 55 to the top of the tower 40, where a pulley 45 guides them vertically back down into the tower 40. The circumference of the pulley is equipped with rubber grooves to hold and pull the individual supply lines 10, 11, 16. The measurement and control wiring are not shown here. They can comprise electrical or glass fiber cables which can be supplied off a much smaller spool located on or in the assembly tower.

The assembly process of the pipe string 48 is carried out in a continuous manner within the tower 40 by automated, computer-controlled robots 50, 51. The inner profile 1 of the pipe string 48 is assembled in the upper level 44. The inner profiles 1 could be stored in the upper level 44 and supplied to the assembly robots 50 by a conveyor. The assembly robots 50 seize the profile 1, for example by means of electromagnetic "hands" 38, and set it on the previously mounted pipe segment. In the following step, they install the isolating mounts 9, by means of which they then attach the supply lines 10, 11, 16 and the measurement and control wiring to the inner profile 1. Once all supply lines and cables are in place, the assembly robots 50 install and bond the external shell elements 44. These shell elements can also be stored in the assembly tower 40 and brought to the work area by a conveyor. The heat curing of the adhesive takes place during the conveyance of the assembled pipe segment from the fourth to the third level. It can be carried out by heating elements incorporated in the joints of the pipe of by external thermal elements. For example, a heated hydraulic molding press (not shown) could be used to hold the parts together and to cure the adhesive in a continuous manner during the boring process. On the third level 43, another line of assembly robots 51 installs the stabilizer rings 34, 35 behind the flanges of the ends of the individual pipe segments, as described earlier. This is followed by the mounting of the fastening sleeves 36, 37. Here again, the supply of parts and their installation is performed in an automated way by a computer-controlled system of conveyors and assembly robots 51 equipped with electromagnetic "hands" 39. These bring the parts into position, press them onto the pipe segment, and heat them for the amount of time required for the adhesive to cure. This process is carried out along with the advance of the pipe string 48 corresponding to the boring speed.

The hydraulic lifting system, consisting of two sets of hydraulic jacks 53, is located in the first and second levels 41, 42. The jacks 53 convey the high propelling pressures necessary for the fusion drilling process over the pipe string 48 to the boring head. They are also designed to lift the relatively heavy full length of pipe string 48 out of the boring after completion of the well. Each of the two hydraulic lifting systems 46, 47 is equipped with hydraulically powered 52 grippers 49. These grippers 49 grasp the pipe string 48 right over a connector sleeve 36, 37 when pushing the pipe string downward, and under the sleeve when lifting the pipe string. The force for the upward and downward translation of the pipe string is provided by two sets of hydraulic jacks 53. The system is slightly over-designed in order to ensure an uninterrupted boring operation in the event that one of the jacks 53 should fail. The force is transmitted from the jacks 53 to the grippers 49 over a continuous beam. The use of two such lifting systems 46, 47 arranged on two levels allows an alternating operation of the two lifting systems 46, 47. This is shown in FIG. 4, where the one set of jacks 53 is pushing the pipe string downward while the other set of jacks 53 is moving upward, with grippers 49 open, in order to recover a standby position for the next forward stroke cycle of the pipe string 48.

Pipe strings with larger diameters can further be strengthened by a vacuum stabilization system. This consists of sealing each new assembled pipe string segment and creating a vacuum in it. The pipe segments can be equipped with valves through which the inner spaces of the pipe are evacuated.

The cooling water is pumped to the boring head under high pressure in order to keep it in a liquid phase. This optimizes the heat exchange and thus the cooling capacity of the water. At the end of its cooling cycle, the water is evacuated from the boring head at its upper side, into the space between the sides of the pipe and the walls of the boring. The pressure of the injected cooling water must be significantly higher than that of the water which is already in the boring. Thus, the released energy of the cooling water can further be used for driving the boring head forward. Steam powered lateral course-correction actuators are located right over the fusion drilling device, in the space between the sides of the pipe string and the walls of the boring. These actuators, which ensure that the boring head stays along its vertical path, are controlled by a signal generated by a gravitation sensor and transmitted by laser over a fiber optic cable. The steam pressure is provided by steam generators located in the fusion drilling device.

Should the pipe string 48 reach a mass exceeding the lifting capacity of the hydraulic systems, 46, 47 or of the connections between the individual segments, an additional step must be added to the retrieval procedure. Once the boring is completed, the pipe string 48 is severed right above the fusion drilling device in such a way as to seal its end, and the space between the sides of the pipe and the walls of the boring is fully flooded. Since the pipe string is hollow, its weight is reduced by the difference between its mass and that of the displaced water. The resulting buoyancy contributes to the lifting force necessary to retrieve the pipe string.

Figure 5:
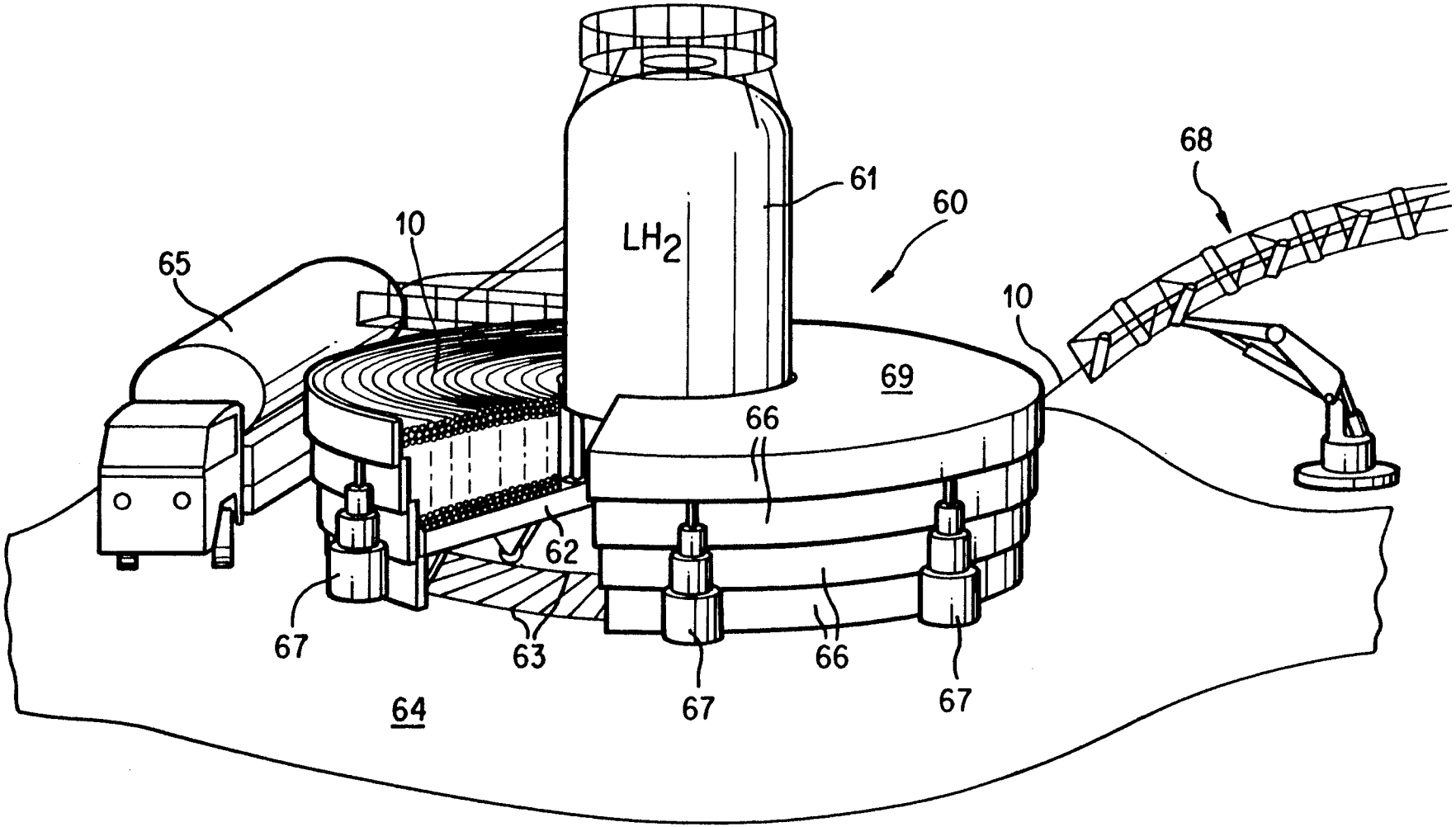
FIG. 5 perspective view with a cut-out of a supply carrousel.

FIG. 5 shows a storage carrousel 60 holding the continuous supply lines 10. The integral length of supply lines needed for a given deep well is stored on and continuously unwound from the carrousel 60. This eliminates the need for joints which could form weak links in the lines. The necessary pressure, cooling and power units as well as the storage tanks 61 are incorporated in the carrousel 60. Such a carrousel 60 comprises a round, rigid platform 62 set on a circular set of rails 63. The rotation of the platform can be driven by a gear drive powered by one or several synchronized electrical motors. The various power and control units and the storage tanks 61 are located at an inner side of the platform 62, at the center of the carrousel 60. An access road 64 for tank trucks 65 surrounds the supply carrousel 60. The tanks 61 can be refueled during the operation of the carrousel 60. The inner end of the supply lines is connected to the tanks over a pumping unit, so that the lines 10 can continuously be supplied with liquid hydrogen, oxygen and cooling water. The supply lines 10 are stored, as on a shelf, in several hundred layers and windings on the outer area of the platform 62. The outer edge of the individual layers is held by hydraulically adjusted rings 66 forming a wall around the circumference of the carrousel 60. The rings 66, designed to hold in place and protect the supply lines, are moved downward by hydraulic jacks 67 placed around the carrousel 60, and expose only the top layer of stored supply lines 10 in order to ensure a smooth unwinding of the continuous lines. The stored supply lines 10 are covered by a watertight, insulating tarp 69. The supply lines 10 are unwound at a speed corresponding to the boring advance and carried by a hydraulically controlled conveyor 68, in a large arc, to the assembly tower. The supply lines 10 must always be kept above their calculated minimal bending radii in order to prevent damage through plastic deformations of the pipe walls. A separate carrousel 10 is available for each type of supply line, in order to avoid synchronization problems if pipes of different diameters are used. The rotation speed of the various carrousels 60 is coordinated by an appropriate adjustment of the drive motor speeds. An equal conveyance velocity of all supply lines 10 to the assembly tower 40 is thus always guaranteed.

I claim:

1. A process for assembling and propelling a high-pressure pipe string for continuous fusion drilling of deep wells which comprises: feeding supply lines (10, 11, 16), measurement instrumentation wiring (17) and control wiring (18) to a boring head in a continuous manner; encasing the supply lines (10, 11, 16), the measurement instrumentation wiring (17) and the control wiring (18) in a tight compression and tension resistant high-pressure pipe string comprising a plurality of pipe segments each comprising an inner profile (1) having a central pipe (2) with a plurality of profiles (3), and a plurality of shell elements (4) secured about the inner profile (1); and propelling the assembled pipe string continuously downward into a boring.

2. A process according to claim 1, wherein the supply lines (10, 11, 16), the measurement instrumentation wiring (17) and the control wiring (18) are fed to the boring from a storage carrousel (60) on which a full required length of the supply lines (10, 11, 16) for the boring is stored.

3. A process according to claim 2, wherein the high-pressure pipe string is assembled with an industrial-grade, hot-curing adhesive.

4. A process according to claim 3, wherein an inside of the pipe string is sealed and evacuated to raise stability of the pipe string.

5. A process according to claim 4, wherein the high-pressure pipe string encasing the supply lines (10, 11, 16), the measurement instrumentation wiring (17) and the control wiring (18) is carried out by computer-controlled assembly robots (50, 51).

6. A process according to claim 5, wherein the high-pressure pipe string is guided by a plurality of steam powered lateral course-correction actuators positioned directly over a fusion drilling device, between sides of the pipe string and walls defining the boring, and is controlled by a gravitation sensor-emitted signal.

7. A process according to claim 6, wherein retrieval of the high-pressure pipe string for its dismantling, once boring is completed, is accomplished by severing the pipe string directly above the fusion drilling device in such a way as to seal an end of the pipe string, and flooding a space between the sides of the pipe and the walls of the boring, thereby reducing a weight of the pipe string by a difference between a mass of the pipe string and that of the displaced water, and a resulting buoyancy contributes to a lifting force necessary to retrieve the pipe string.

8. A system for assembling and propelling a high-pressure pipe string for continuous fusion drilling of deep wells, the system comprising: at least one storage carrousel (60), an assembly tower (40), the storage carrousel (60) receiving a plurality of wound up supply lines (10, 11, 16), measurement instrumentation wiring (17) and control wiring (18), the storage carrousel comprising a circular, rotating and motor-driven platform (62), and a multi-level (41 to 44) assembly tower (40) housing means (50, 51; 46, 47) for assembling a plurality of pipe segments and for propelling the pipe string downward into a boring.

9. A system according to claim 8, wherein the assembly tower (40) houses a hydraulic jack system (46, 47) for continuous, two-cycle propelling of the pipe string.

10. A high-pressure pipe string for continuous fusion drilling of deep wells comprising: the pipe string housing a plurality of supply lines (10, 11, 16), measurement instrumentation wiring (17) and control wiring (18) for a bore head; the pipe string comprising at least two shell elements (4) forming the two halves of a plurality of pipe segments of the pipe string; and means (3, 5 to 7) for assembling the pipe segments into a continuous, smooth, tight, and compression and tension resistant, pipe.

11. A high-pressure pipe string according to claim 10, wherein stability of the pipe string is increased with at least one inner profile element (1) positioned inside of the pipe string and secured to the shell elements (4) of one of the pipe segments.

12. A high-pressure pipe string according to claim 11, wherein the assembling means comprise a plurality of smooth, plane bonding surfaces (5 to 7) which can be bonded by a hot-curing, industrial-grade adhesive with a high shear and tensile strength.

13. A high-pressure pipe string according to claim 12, wherein isolating mounts 9 holding in place, by frictional forces, the continuous supply lines (10, 11, 16, 17, 18) are mounted in open areas (12 to 15) between profiles of the inner profile element (1) and the pipe string.

14. A high-pressure pipe string according to claim 13, wherein the inner profile element (1) and the shell elements (4) in two adjacent said pipe segments are at least one of adhesively bonded and screwed together with a stabilizing ring (34, 35) and a fastening sleeve (36, 37).

15. A process according to claim 1, wherein the high-pressure pipe string is assembled with an industrial-grade, hot-curing adhesive.

16. A process according to claim 1, wherein an inside of the pipe string is sealed and evacuated to raise stability of the pipe string.

17. A process according to claim 1, wherein the high-pressure pipe string encasing the supply lines (10, 11, 16), the measurement instrumentation wiring (17) and the control wiring (18) is carried out by computer-controlled assembly robots (50, 51).

18. A process according to claim 1, wherein the high-pressure pipe string is guided by a plurality of steam powered lateral course-correction actuators positioned directly over a fusion drilling device, between sides of the pipe string and walls defining the boring, and is controlled by a gravitation sensor-emitted signal.

19. A process according to claim 1, wherein retrieval of the high-pressure pipe string for its dismantling, once boring is completed, is accomplished by severing the pipe string directly above a fusion drilling device in such a way as to seal an end of the pipe string, and flooding a space between sides of the pipe and walls of the boring, thereby reducing a weight of the pipe string by a difference between a mass of the pipe string and that of the displaced water, and a resulting buoyancy contributes to a lifting force necessary to retrieve the pipe string.

20. A high-pressure pipe string according to claim 10, wherein the assembling means comprise a plurality of smooth, plane bonding surfaces (5 to 7) which can be bonded by a hot-curing, industrial-grade adhesive with a high shear and tensile strength.

21. A high-pressure pipe string according to claim 10, wherein isolating mounts 9 holding in place, by frictional forces, the continuous supply lines (10, 11, 16, 17, 18) are mounted in open areas (12 to 15) between profiles of the inner profile element (1) and the pipe string.

22. A high-pressure pipe string according to claim 10, wherein the inner profile element (1) and the shell elements (4) in two adjacent said pipe segments are at least one of adhesively bonded and screwed together with a stabilizing ring (34, 35) and a fastening sleeve (36, 37).

* * * * *